United States Patent [19]

Gentile et al.

[11] Patent Number: 4,636,179

[45] Date of Patent: Jan. 13, 1987

[54] FOLDER

[75] Inventors: Stephan F. Gentile; Mark A. Gentile, both of Edinburg, Va.

[73] Assignee: Gentile Brothers Screen Printing, Inc., Edinburg, Va.

[21] Appl. No.: 732,692

[22] Filed: May 10, 1985

[51] Int. Cl.[4] ..... B42F 13/00; B42F 19/00

[52] U.S. Cl. ..... 402/79; 402/80 R; 281/29; 281/31; 283/63 R; 283/52; 283/56

[58] Field of Search ..... 281/16, 15 R, 29, 31; 283/58, 63 R, 63 A, 81, 101, 105, 56, 52, 54; 402/73, 4, 79, 80 R

[56] References Cited

U.S. PATENT DOCUMENTS

| | | | |
|---|---|---|---|
| 1,157,432 | 10/1915 | Simpson et al. . | |
| 2,321,184 | 5/1942 | Butterworth . | |
| 3,159,329 | 12/1964 | Hiersteiner . | |
| 3,164,317 | 1/1965 | Bogen . | |
| 3,930,700 | 1/1970 | Figueres | 283/63 R X |

FOREIGN PATENT DOCUMENTS

| | | | |
|---|---|---|---|
| 869519 | 2/1942 | France | 283/52 |

*Primary Examiner*—Paul A. Bell

*Attorney, Agent, or Firm*—Schwartz, Jeffery, Schwaab, Mack, Blumenthal & Evans

[57] ABSTRACT

A folder has a base sheet including a base tab portion on one outside edge. An overlapping sheet extends over an inside surface of the base sheet to provide a pocket between the overlapping sheet and one part of the inside surface of the base sheet. The overlapping sheet includes an overlapping tab portion which extends over the base tab portion to provide a plural thickness tab. At least part of the overlapping tab portion is affixed to the base sheet to provide a pocket with at least one closed lateral edge. The base sheet also includes a flap portion extending therefrom, which flap portion is folded into overlying relationship with another inside surface of the base sheet. The flap portion includes an area having the shape of a rotary file card which may be detached from the folder to provide a rotary file card.

26 Claims, 4 Drawing Figures

FOLDER

BACKGROUND OF THE INVENTION

1. Field of the Invention

The present invention relates to a folder, and in particular to a folder of the type having an inside pocket and upstanding tab.

2. Description of the Prior Art

It is well known in the art to provide folders with internal pockets. It is also known to provide folders with upstanding tabs for facilitating recognition of the folder in retrieval from a file drawer. One problem with known folders having internal pockets, however, is that the pockets tend to be difficult and expensive to manufacture, particularly where a strong and secure pocket is needed. These difficulties are compounded if it is desired to have printing on the part of the pocket visible to the user of the folder when the folder is open and materials are contained in the pocket.

Another problem with known designs for folders which include internal pockets is that the provision of a pocket may be at odds with the use of a tab on the folder, which tab facilitates retrieval from a file drawer, briefcase, etc. In this regard, one method of producing a pocket in a folder involves folding over a lateral outside edge of the folder and affixing it to a lower flap which has been folded up into the inside of the folder to form a pocket. The folded-over outer edge is glued to the flap to create the pocket. However, folding over of the outer lateral edge complicates and reduces the possibilities for providing a tab on the outer lateral edge.

Another drawback of prior art folders is that the tabs tend to be weak and subject to damage. Since the tabs protrude from the folder, they tend to be subject to tearing, folding over, or general weakening when being bumped or pushed against objects in the course of handling. Of course, folders with such tabs then become difficult to find and retrieve.

It is also known in the art to provide promotional packages to actual or prospective customers or clients which include preprinted rotary file cards containing information such as a vendor's name, address and telephone number. Such rotary file cards may then be conveniently placed in the customer's existing rotary card file for easy access to information about the vendor. A drawback, however, is that such preprinted rotary file cards must often be printed in a separate operation from the printing of the other promotional material; and, in particular, they are typically printed in an operation separate from the printing of information on the folder itself. In addition, with known packages containing rotary file cards, the rotary file cards may be loose and subject to being lost or misplaced before they can be put into the customer's rotary file. Finally, the rotary file card provided may not be the same size as the particular rotary file used by the customer.

OBJECTS OF THE INVENTION

It is an object of the present invention to overcome the foregoing drawbacks of the prior art.

It is yet another object of the present invention to provide a folder which is very economical to produce and yet which contains a strong and secure internal pocket.

It is another object of the present invention to provide a folder in which both a pocket and tab may be economically provided on the same folder.

It is a further object of the invention to provide a folder in which at least part of the pocket is integral with the tab.

It is a related object of the present invention to provide a folder in which the provision of a tab actually facilitates rather than hampers the provision of the pocket.

It is also an object of the present invention to provide a folder in which the pocket is particularly roomy, i.e., more roomy than in conventional folders.

It is a further object of the present invention to provide a folder in which the tab is especially strong and rigid and not easily subject to damage during handling.

It is still a further object of the invention to provide a folder in which at least one preprinted rotary file card is provided with the folder, which file card may be detached from the folder by the end user to be placed in a rotary file.

It is a related object of the present invention to provide such a folder with rotary file cards of different sizes to ensure a size will be available to fit the particular rotary file of the end user.

It is yet another object of the present invention to provide a folder in which printing placed on only one side of the folder, when the folder is in an unassembled condition, appears on both the inside and the outside of the folder when the folder is in an assembled condition.

It is a related object of the present invention to provide a folder in which such printing on only one side in the unassembled condition results in printing on both sides of a tab in the assembled condition.

It is also a related object of the present invention to provide a folder in which such printing on only one side in the unassembled condition results in printing on the inside of the folder and, in particular, on the visible portion of the pocket of the inside of the folder.

It is also a related object of the present invention to provide a folder in which such printing on only one side of the folder in an unassembled condition results in one or more preprinted, integral rotary file cards on the inside of the folder when the folder is in an assembled condition.

These and other objects and advantages of the present invention will become more apparent from the detailed description which follows and from the drawings.

SUMMARY OF THE INVENTION

The foregoing drawbacks of the prior art and the foregoing objects are achieved by providing a folder with a base sheet, which base sheet has a base tab portion on one of its outside edges and an overlapping sheet which extends over an inside surface of the base sheet to provide a pocket between the overlapping sheet and one part of the inside surface of the base sheet. The overlapping sheet includes an overlapping tab portion which extends over the base tab portion to provide a plural thickness tab. At least part of the overlapping tab portion is affixed to the base sheet to provide a pocket with at least one closed lateral edge.

The base sheet also includes a flap portion extending therefrom, which flap portion is folded into overlying relationship with another inside surface of the base sheet. At least part of the flap portion includes an area having the shape of a rotary file card which may be detached from the folder to provide a rotary file card.

When the base sheet is in an unassembled condition, it includes printing on only one side, i.e., the side which provides the outside surface of the folder when the folder is in an assembled condition. This printing on only one side includes printing on the overlapping sheet. When the folder is in the assembled condition and the overlapping sheet folded into position to create a pocket, the printing which had been only on one side will then appear on the visible portion of the pocket at the inside of the folder. The printing on only one side of the base sheet in an unassembled condition also includes printing on the base tab portion and overlapping tab portion. When the folder is then assembled and these tab portions joined, a tab is then provided with printing on both sides. The base sheet printed on only one side in the unassembled condition also includes printing on the flap in which the rotary file cards are defined. This results in preprinted rotary file cards on the inside of the folder when the folder is in the assembled condition.

DETAILED DESCRIPTION

Figure 1:
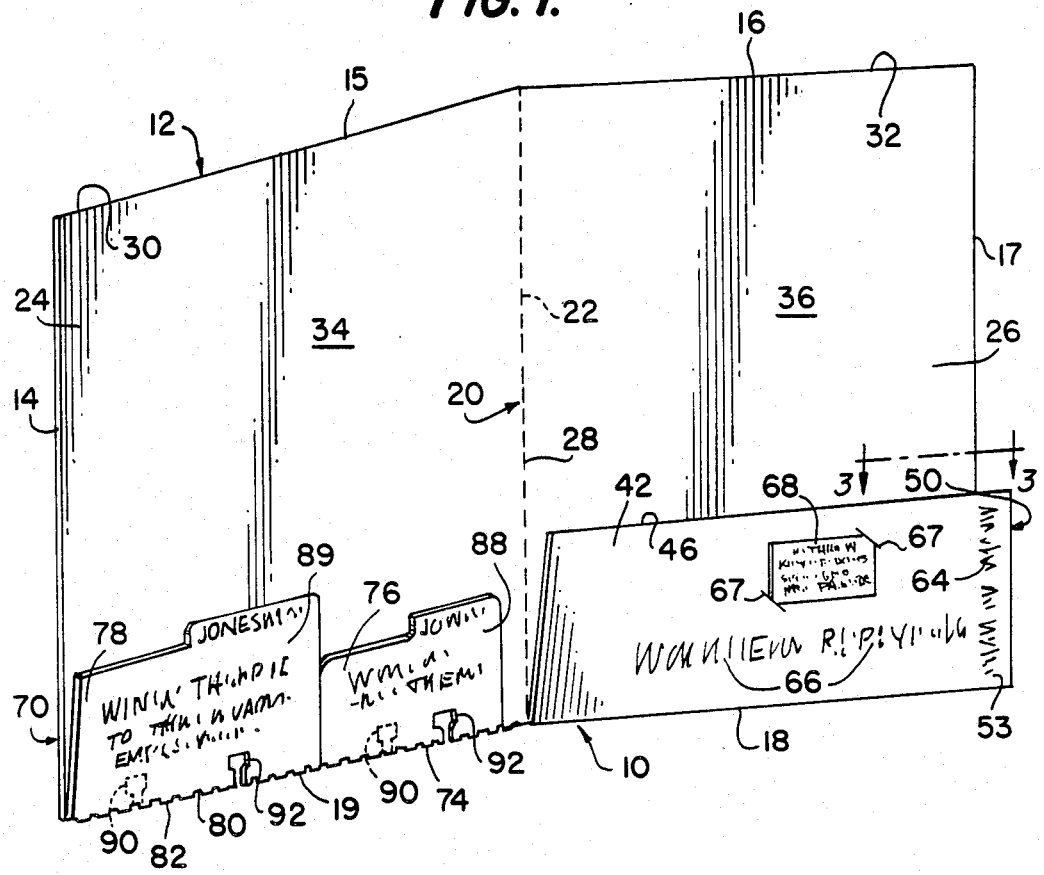
FIG. 1 is a perspective view of a folder according to the present invention showing the inside of the folder in a partially open condition, which folder is also in its assembled condition.
Figure 4:
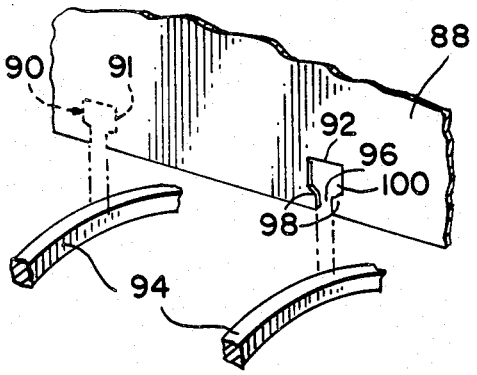
FIG. 4 is a fragmentary, detailed perspective view showing the cooperation between a rotary file card and the guides of a rotary file card holder.

In the following description and in the drawings, like reference characters among the various figures of the drawing refer to like elements or features.

Reference numeral 10 generally refers to an exemplary embodiment of a folder according to the present invention. While the folder 10 may have many uses, it is particularly useful for promotional literature which one may distribute to existing or potential business customers or clients. The folder 10 is especially well suited for easy filing of the promotional literature and for facilitating easy retrieval by the actual or prospective customer or client of information relating to the products, services or business of the party who provided the folder.

Figure 2:
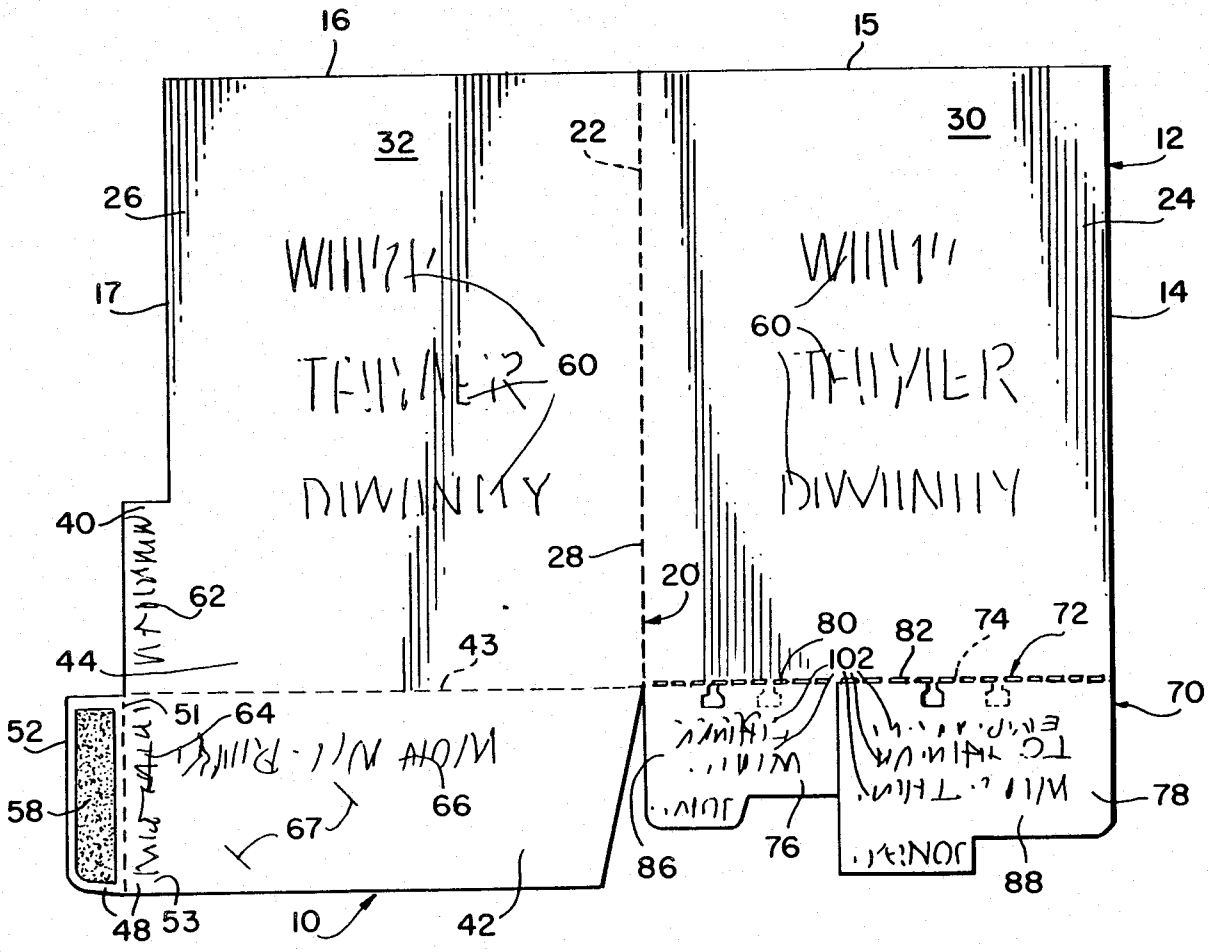
FIG. 2 is a plan view of a folder according to the present invention in an unassembled condition and showing primarily the outside of the folder, but with various depending components which will be folded over to the inside of the folder when the folder is in the assembled condition of FIG. 1.

Referring to FIGS. 1 and 2, folder 10 includes a base sheet 12 defined by a set of outside edges 14, 15, 16, 17, 18 and 19. As viewed from the perspective of FIGS. 1 and 2, outside edges 14, 15, 16, 17, 18 and 19 have different dispositions because FIG. 2, in general, illustrates the reverse side, i.e., the flip side of the folder as shown in FIG. 1. Specifically, FIG. 1 shows the inside of the assembled folder when the folder is partially open and FIG. 2 shows the outside of the folder, albeit in an unassembled condition. When the folder is assembled, elements toward the bottom of the drawing in FIG. 2 will be folded over toward the inside of the folder 10, as will be described further.

A central score region generally referred to by reference numeral 20 runs between the set of edges 15, 16, on the one hand, and the set of edges 18, 19, on the other hand, which sets of edges are opposite each other. Base sheet 12 is foldable along the central score region 20. When base sheet 12 is folded at a central fold line 22 which extends along the central score region 20, it has a front side portion 24, which will generally constitute the front cover leaf of the folder, and back side portion 26, which will generally constitute the rear cover leaf of the folder when assembled and used. Central fold line 22 defines a boundary 28 (which boundary coincides with fold line 22) between front side portion 24 and back side portion 26. Front side portion 24 includes an outside surface 30 and back side portion 26 includes an outside surface 32, these outside surfaces facing the exterior of the folder 10 when the folder is in a folded condition. Similarly, front side portion 24 includes an inside surface 34 and back side portion 26 includes an inside surface 36, these inside surfaces 34 and 36 facing the interior of the folder when folded.

Base sheet 12 includes a base tab portion 40 best seen from the vantage of the unassembled folder shown in FIG. 2. Base tab portion 40 is disposed along outside edge 17 and adjacent one corner of the base sheet 12.

Figure 3:
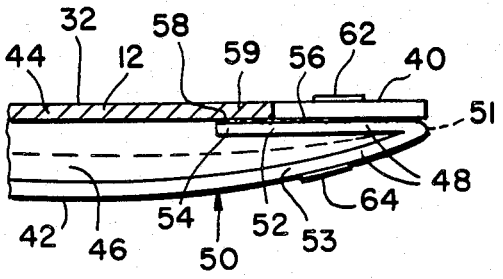
FIG. 3 is a fragmentary, detailed sectional view taken on the line 3—3 of FIG. 1 and showing details of the plural thickness tab and pocket.

A flap portion or overlapping sheet 42 is shown in an assembled, overlapping condition in FIGS. 1 and 3 and in an unassembled, non-overlapping condition in FIG. 2. Overlapping sheet 42 will, in the assembled condition, overlap one of the inside surfaces, namely, inside surface 36 in the particular exemplary embodiment shown and described herein. In this particular embodiment, overlapping sheet 42 is integral with back side portion 26 of base sheet 12 and is defined by a outer score region or fold 43 (FIG. 2) along which overlapping sheet 42 may be folded into overlapping relationship with inside surface 36.

It will be apparent that overlapping sheet 42 extends over one part 44 (FIGS. 2 and 3) of inside surface 36 to provide a pocket 46 between overlapping sheet 42 and part 44 of inside surface 36.

Overlapping sheet 42 includes an overlapping tab portion 48 (FIGS. 2 and 3). This overlapping tab portion 48 extends over the base tab portion 40 to provide a plural thickness tab 50. In the preferred embodiment shown and described, overlapping tab portion 48 is folded at line 51 to provide a part 52 of overlapping tab 48 which is affixed to the base sheet and another part 53 of the overlapping tab portion which will face the exterior of the folder when the folder is assembled and assumes a folded condition. In the particular embodiment shown, part 52 which is affixed to the base sheet is primarily affixed to the base tab portion 40 of base sheet 12 but also includes a part 54 (FIG. 3) which extends onto another portion 59 of base sheet 12; i.e., part 54 extends into the area of base sheet 12 which is disposed inside the base tab portion 40. Thus, the part 52 disposed outwardly of fold line 51 in FIG. 2 constitutes a region folded back on itself, this region being in contact with and affixed to base sheet 12, including both the base sheet 12 proper (and specifically part 54 thereof) and its base tab portion 40. This region which is folded back on itself (i.e., part 52) is affixed to the base sheet by adhesive 58 (FIGS. 2 and 3).

Base sheet 12, when in the unassembled, unfolded condition shown in FIG. 2, includes printing on only one side, i.e., the side visible in FIG. 2, which side includes outside surfaces 30 and 32. When the base sheet 12 has been assembled and glued as shown in FIG. 1, however, certain of the printing which was on only one side in the unassembled, unfolded condition of FIG. 2 will have been moved to the inside, and the plural thickness tab 50 will have printing on both sides. Thus, according to the present invention, printing on only one side of an unfolded, unassembled sheet results in printing on multiple sides as well as on both sides of a tab when the sheet has been folded and assembled.

The printing on only one side, in the unassembled, unfolded condition of FIG. 2, includes printing 60 on outside surfaces 30 and 32. This printing 60 will remain on the exterior of the folder when the folder is assembled and folded as shown in FIG. 1. Because FIG. 1 shows the folder in an assembled and partially folded-over condition, printing 60 is not visible in the view of FIG. 1.

The printing on only one side also includes printing 62 (FIG. 2) on the base tab 40. That is, printing 62 on base tab portion 40 faces in the same direction as outside surfaces 30, 32 of base sheet 12 and does so both when base sheet 12 is in its unassembled condition of FIG. 2 and its assembled condition of FIG. 1. This printing 62 will be visible on the part of the tab which faces in the same direction as outside surface 32 of back side portion 26 (i.e., the side of the tab which cannot be seen in FIG. 1) when the base sheet 12 is in a folded, assembled condition.

Overlapping tab portion 48 includes printing 64 thereon. That is, printing 64 on overlapping tab portion 48 faces in the same direction as outside surfaces 30, 32 when the folder is in the unassembled condition of FIG. 2. When the overlapping sheet 42, including its overlapping tab 48, is moved from the unassembled, unfolded condition of FIG. 2 to an assembled, partially folded condition of FIG. 1, printing 64 will then face in the same direction as inside surface 36. When folder 10 is fully folded, such as to place the same in a file cabinet, printing 64 will face in the same direction as the front of the folder, i.e., the same direction as outside surface 30 of front side portion 24. Printing 64 is the most likely to be seen first in retrieving the folder 10 from a file cabinet.

Printing 66 is disposed on overlapping sheet 42. That is, printing 66 faces in the same direction as outside surfaces 30, 32 when the folder 10 is in the unassembled condition of FIG. 2. This printing 66 is initially on the same side as printing 60 (i.e., the printing that remains on the outside of the folder.) When overlapping sheet 42 is folded along line 43 from the unassembled condition of FIG. 2 to the assembled condition of FIG. 1, the printing 66 is moved from the outside to the inside of the folder, thus giving the appearance of printing on both sides. That is, the assembled folder has printing on two sides, but such a folder has been produced with the economy of providing printing on only one side. In the assembled condition of FIG. 1, printing 66 on overlapping sheet 42 faces in the same direction as inside surface 36 of back side portion 26. When the folder 10 is in the unassembled condition of FIG. 2, printing 66 is inverted (i.e., upside down). When the folder 10 is in the assembled condition of FIG. 1, however, the printing will have been moved into a condition where it is no longer inverted (i.e., where it is right side up.)

Flap portion or overlapping sheet 42, in addition to printing 66, may also include slits 67 into which may be placed a business card 68 of the party providing the folder 10 to an actual or prospective customer or client.

Base sheet 12 may include another flap portion 70 which, in the embodiment shown and described herein, is located on the side of the folder opposite pocket 46. That is, flap 70 is located on front side portion 24. In the unassembled condition of FIG. 2, flap portion 70 extends outwardly from base sheet 12 and is defined by an outer score region 72 running between flap portion 70 and that part of the base sheet 12 from which flap 70 extends. Flap portion 70, when folded at an outer fold line 74 which extends along outer score region 72 and coincides therewith, is in overlying relationship with inside surface 34 of front side portion 24.

At least part of flap portion 70 includes an area having the shape of a rotary file card. In the particular embodiment shown and described herein, there are two such areas, namely, area 76 having the shape of a small rotary file card and area 78 having the shape of a larger rotary file card. These areas 76 and 78 having the shape of rotary file cards are partially defined by a border 80, along which border a small rotary file card 86 corresponding with area 76 and a large rotary file card 88 corresponding with area 78 may be detached from the folder to be used in a rotary file. Detachment is effected by a row of perforations 82 running along border 80. In the particular embodiment shown and described, border 80 coincides with the outer score region 72 and its outer fold line 74, although this need not necessarily be the case. The provision of two rotary file cards 86, 88 in folder 10 ensures that a rotary file card identifying the party distributing the folder will be available to fit the particular size of rotary file used by the actual or prospective customer or client of the party distributing the folder.

In order to facilitate use of rotary file cards 86, 88 in conventional rotary files, each rotary file card includes structure for coupling the card into a rotary file. In the particular exemplary embodiment shown and described, two versions of similar couplings are shown for illustrative purposes only, and only one of these two versions would be used in actual practice. In one version, an opening 90 is defined by perforations 91 so that a blank may be removed by the user after the card has been removed from the folder. In another version, opening 92 has already been provided so that there is no need for removal of a blank defined by perforations. Either type of opening, i.e., opening 90 defined by perforations or existing opening 92, cooperates with guide 94 of a rotary file card holder. Each opening 90, 92 includes a restricted passage 96 having sides 98 which yield when the guide 94 on the rotary file card holder is passed through passage 96. Likewise, each type of opening 90, 92 includes a receiving space 100 in which guide 94 of the rotary file card holder is seated for normal use after such guide has passed through restricted passage 96.

The previously described printing on only one side of base sheet 12 includes printing 102 on flap portion 70, which printing also constitutes printing 102 on the large and small rotary file cards 86, 88. As with printing 66, printing 102 is initially inverted when the folder is unassembled (FIG. 2), but is no longer inverted after assembly (FIG. 1.) Thus, the rotary file cards 86, 88 are preprinted, and this printing is provided by the same, economical, one-sided printing step which provides printing on the outside of folder 10, on the inwardly-facing, overlapping sheet 42 forming the pocket 46, and on both the front and back of the plural thickness tab 50.

As already indicated, the folder shown and described herein will, in an assembled condition, have printing on many of its most visible surfaces which face in different directions even though the printing was produced very economically on only one side of the folder when in an unassembled condition. The folder according to the present invention is particularly suitable for use in providing information and material to another, which material may very easily be filed for quick future reference by the person to whom it is provided, such as an actual or prospective customer or client. For instance, the pocket 46 may be used to contain information on a party's product or service as well as any notes which the prospective customer or client may have taken. The preprinted, multiple thickness tab will be readily visible when the folder 10 is placed in a file cabinet, particularly since the printing on the tab will be visible from both sides. This ensures that the printing or indicia on the tab can be seen regardless of whether the folder is filed backwards or whether the search for the file is approached from other than the front side of the folder. In addition, the plural thickness of the tab 50 ensures that the tab will not become weak or folded over, which further ensures easy retrieval. By making the pocket and plural thickness tab integral with each other (i.e., the front side of the tab, i.e., part 53 visible in FIG. 1 is integral with the overlapping sheet 42 forming the pocket 46), manufacturing is facilitated and a particularly roomy pocket is also provided. Further, a particularly economical and convenient way of producing and distributing preprinted rotary file cards is provided, and provision is further made to ensure that a rotary file card that fits the end user's particular size of rotary file.

Although the invention has been shown and described by way of a particular preferred embodiment, many other embodiments, as well as many modifications and variations, are possible within the scope of the appended claims.

What is claimed is:

1. A folder comprising:

(a) a base sheet defined by a set of outside edges;

(b) a central score region running between a pair of opposed outside edges along which region said base sheet is foldable, whereby said base sheet, when folded at a central fold line which extends along said central score region, has a front side portion and a back side portion, a boundary between said side portions being defined by said central fold line, each side portion including an outside surface which faces the exterior of the folder, when folded, and an inside surface, which faces the interior of the folder, when folded;

(c) said base sheet including a base tab portion on one of said outside edges thereof;

(d) an overlapping sheet on at least one of said inside surfaces, said overlapping sheet extending over one part of said one inside surface to provide a pocket between said overlapping sheet and said one part of said inside surface, said overlapping sheet including an overlapping tab portion, said overlapping tab portion extending over said base tab portion to provide a plural-thickness tab, at least part of said overlapping tab portion being affixed to said base sheet to provide a pocket with at least one closed lateral edge.

2. A folder as defined in claim 1, wherein said overlapping tab portion has a region folded back on itself, said region folded back on itself being in contact with and affixed to said base sheet.

3. A folder as defined in claim 2, wherein said region folded back on itself is affixed to said base sheet by adhesive.

4. A folder as defined in claim 3, wherein said region folded back on itself contacts both said base tab portion of said base sheet and another portion of said base sheet.

5. A folder as defined in claim 1, wherein said overlapping sheet is integral with said base sheet and is defined by a fold at one of said outside edges of said base sheet, whereby said overlapping sheet is folded over said base sheet into overlapping relationship with said base sheet.

6. A folder as defined in claim 5, wherein said base sheet, when in an unassembled condition, includes printing on only one side, which side provides said outside surfaces when said folder is in an assembled condition.

7. A folder as defined in claim 6, wherein said printing on only one side in an unassembled condition includes printing on one side of said overlapping sheet, which one side faces in the same direction as said outside surfaces when the folder is in an unassembled condition and which one side faces in the same direction as one of said inside surfaces of said base sheet when said folder is in an assembled condition.

8. A folder as defined in claim 7, wherein said printing on only one side of said base sheet in an unassembled condition further includes printing on said base tab portion and said overlapping tab portion, said printing on said base tab portion facing in the same direction as said outside surfaces of said base sheet when said folder is in both its unassembled and assembled conditions, said printing on said overlapping tab portion facing in the same direction as said outside surfaces of said base sheet when the folder is in the unassembled condition and in the same direction as one of said inside surfaces of said base sheet when the folder is in the assembled condition, whereby, with said printing on only one side, a plural-thickness tab is provided which has printing on both sides.

9. A folder comprising:

(a) a base sheet defined by a set of outside edges;

(b) a central score region running between a pair of opposed outside edges along which region said base sheet is foldable, whereby said base sheet, when folded at a central fold line which extends along said central score region, has a front side portion and a back side portion, a boundary between said side portions being defined by said central fold line, each side portion including an outside surface which faces the exterior of the folder, when folded, and an inside surface, which faces the interior of the folder, when folded;

(c) said base sheet including one flap portion extending outwardly from one of said side portions and another flap portion extending outwardly from the other of said side portions, said flap portions each being defined by an outer score region running between said flap portion and another part of said base sheet, whereby each said flap portion, when folded along said outer score region, is in overlying relationship with said inside surface of one of said side portions;

(d) one of said flap portions including an area constituting a rotary file card, which area is partially defined by a border, which border includes means for detaching said rotary file card from the folder to provide a detached rotary file card;

(e) said rotary file card including means for coupling said rotary file card with a rotary file card holder, said coupling means including means defining a pair of openings which cooperate with guides of a rotary file card holder, each opening including a restricted passage having sides which yield when a guide on a rotary file card holder is passed through said passage and a receiving space in which the guide is seated for normal use after it has passed through said restricted passage.

10. A folder as defined in claim 9, wherein said base sheet, when in an unassembled condition, includes printing on only one side, which side provides said outside surfaces when said folder is in an assembled condition.

11. A folder as defined in claim 10, wherein said printing on only one side in an unassembled condition includes printing on one side of said one flap portion, which one side faces in the same direction as said outside surfaces when the folder is in an unassembled condition and which one side faces in the same direction as said inside surfaces of said base sheet when said folder is in an assembled condition.

12. A folder as defined in claim 11, wherein said printing on only one side of said base sheet in an unassembled condition further includes printing on said area constituting a rotary file card, which printing faces in the same direction as said outside surfaces of said base sheet when said folder is in an unassembled condition and in the same direction as said inside surfaces of said base sheet when the folder is in the assembled condition, whereby, with said printing on only one side, a folder is provided having printing on the outside and a preprinted rotary file card on the inside.

13. A folder as defined in claim 9, wherein said one flap portion includes a plurality of said areas constituting rotary file cards to provide a plurality of rotary file cards.

14. A folder as defined in claim 9, wherein said means for detaching said area constituting a rotary file card includes a row of perforations running along said border partially defining said area constituting a rotary file card to facilitate detachment of said rotary file card.

15. A folder comprising:

(a) a base sheet defined by a set of outside edges;

(b) a central score region running between a pair of opposed outside edges along which region said base sheet is foldable, whereby said base sheet, when folded at a central fold line which extends along said central score region, has a front side portion and a back side portion, a boundary between said side portions being defined by said central fold line, each said front and back portions including an outside surface which faces the exterior of the folder, when folded, and an inside surface, which faces the interior of the folder, when folded;

(c) said base sheet including a main tab portion at one of said outside edges thereof;

(d) an overlapping sheet on at least one of said inside surfaces, said overlapping sheet extending over one part of said one inside surface to provide a pocket between said overlapping sheet and said one part of said inside surface, said overlapping sheet including an overlapping tab portion, said overlapping tab portion extending over said main tab portion to provide a plural-thickness tab, at least part of said overlapping tab portion being affixed to said base sheet to provide a pocket with at least one closed lateral edge;

(e) said base sheet including a flap portion extending outwardly therefrom, said flap portion being defined by an outer score region running between said flap portion and another part of said base sheet, whereby said flap portion, when folded at an outer fold line which extends along said outer score region, is in overlying relationship with said inside surface of at least one of said side portions;

(f) at least part of said flap portion including an area having the shape of a rotary file card, which area is partially defined by a border, which border includes means for detaching said area having the shape of a rotary card file from the folder to provide a rotary file card;

(g) said rotary file card including means for coupling said rotary file card with a rotary file card holder, said coupling means including means defining a pair of openings which cooperate with guides on a rotary file card holder, each opening including a restricted passage having sides which yield when a guide on a rotary file card holder is passed through said passage and a receiving space in which the guide is seated for normal use after it has passed through said restricted passage.

16. A folder as defined in claim 15, wherein said overlapping tab portion has a region folded back on itself, said region folded back on itself being in contact with and affixed to said base sheet.

17. A folder as defined in claim 16, wherein said region folded back on itself is affixed to said base sheet by adhesive.

18. A folder as defined in claim 17, wherein said region folded back on itself contacts both said base tab portion of said base sheet and another portion of said base sheet.

19. A folder as defined in claim 15, wherein said overlapping sheet is integral with said base sheet and is defined by a fold at one of said outside edges of said base sheet, whereby said overlapping sheet is folded over said base sheet into overlapping relationship with said base sheet.

20. A folder as defined in claim 15, wherein said base sheet, when in an unassembled condition, includes printing on only one side, which side provides said outside surfaces when said folder is in an assembled condition.

21. A folder as defined in claim 20, wherein said printing on only one side in an unassembled condition includes printing on one side of said overlapping sheet, which one side faces in the same direction as said outside surfaces when the folder is in an unassembled condition and which one side faces in the same direction as one of said inside surfaces of said base sheet when said folder is in an assembled condition.

22. A folder as defined in claim 21, wherein said printing on only one side of said base sheet in an unassembled condition further includes printing on said base tab portion and said overlapping tab portion, said printing on said base tab portion facing in the same direction as said outside surfaces of said base sheet when said folder is in both its unassembled and assembled conditions, said printing on said overlapping tab portion facing in the same direction as said outside surfaces of said base sheet when the folder is in the unassembled condition and in the same direction as one of said inside surfaces of said base sheet when the folder is in the assembled condition, whereby, with said printing on only one side, a plural-thickness tab is provided which has printing on both sides.

23. A folder as defined in claim 20, wherein said printing on only one side in an unassembled condition includes printing on one side of said flap, which one side faces in the same direction as said outside surfaces when the folder is in an unassembled condition and which one side faces in the same direction as said inside surfaces of said base sheet when said folder is in an assembled condition.

24. A folder as defined in claim 23, wherein said printing on only one side of said base sheet in an unassembled condition further includes printing on said area having the shape of a rotary file card, which printing faces in the same direction as said outside surfaces of said base sheet when said folder is in an unassembled condition and in the same direction as said inside surfaces of said base sheet when the folder is in the assembled condition, whereby, with said printing on only one side, a folder is provided having printing on the outside and a preprinted rotary file card on the inside.

25. A folder as defined in claim 15, wherein said flap portion includes a plurality of said areas having the shape of a rotary file card to provide a plurality of rotary file cards.

26. A folder as defined in claim 15, wherein said means for detaching said area having the shape of a rotary file card includes a row of perforations running along said border partially defining said area having the shape of a rotary file card to facilitate detachment of said rotary file card.

* * * * *